US008254590B2

(12) United States Patent
Taenzer

(10) Patent No.: US 8,254,590 B2
(45) Date of Patent: Aug. 28, 2012

(54) SYSTEM AND METHOD FOR INTELLIGIBILITY ENHANCEMENT OF AUDIO INFORMATION

(75) Inventor: Jon C. Taenzer, Los Altos, CA (US)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 771 days.

(21) Appl. No.: 12/432,629

(22) Filed: Apr. 29, 2009

(65) Prior Publication Data

US 2010/0278353 A1 Nov. 4, 2010

(51) Int. Cl.
*H04R 3/02* (2006.01)

(52) U.S. Cl. ..... 381/73.1; 381/94.1; 381/94.2

(58) Field of Classification Search ..... 381/73.1, 381/56, 57, 94.1, 94.2, 94.3
See application file for complete search history.

(56) References Cited

U.S. PATENT DOCUMENTS

| | | | | |
|---|---|---|---|---|
| 4,982,427 | A * | 1/1991 | Nicolai | 379/406.01 |
| 2003/0016833 | A1 * | 1/2003 | Harvey | 381/71.5 |
| 2004/0099129 | A1 * | 5/2004 | Ludwig | 84/663 |
| 2005/0111683 | A1 * | 5/2005 | Chabries et al. | 381/317 |
| 2006/0262938 | A1 * | 11/2006 | Gauger et al. | 381/56 |
| 2009/0274310 | A1 * | 11/2009 | Taenzer | 381/57 |

* cited by examiner

*Primary Examiner* — Kevin M Picardat
(74) *Attorney, Agent, or Firm* — Nixon Peabody LLP

(57) ABSTRACT

A method for processing an input signal to create an enhanced output signal includes obtaining an envelope of the input signal, determining a logarithm signal of the envelope, determining a rate of change of the logarithm signal to obtain a slope value, and applying a value derived from the slope value to the input signal to thereby generate an enhanced output signal.

37 Claims, 6 Drawing Sheets

SYSTEM AND METHOD FOR INTELLIGIBILITY ENHANCEMENT OF AUDIO INFORMATION

TECHNICAL FIELD

The present disclosure relates to audio playback, for example in two-way communications systems such as cellular telephones and walkie-talkies, or in one-way sound delivery systems such as audio entertainment systems.

BACKGROUND

Ambient noise may sometimes interfere with the delivery of audio information. In a two-way communication system for example, in which the far-end talker is at a location remote from the near-end listener, the far-end talker, ignorant of the noise conditions at the listener's location, may not take measures to compensate for the occurrence of disruptive noise events (instantaneous or sustained) at the listener's location. For example, the talker, unaware of a passing car at the listener's location, may not raise his/her voice to maintain audibility to the listener, and the talker's words may not be heard or understood by the listener, even if the system were electrically and mechanically capable of handling such compensation. The inability of the listener to discern the talker's speech under such circumstances is due to the well known psychophysical phenomenon called "masking"—that is, when loud enough, the local noise covers up, or masks, the played-back far-end sound signal. This problem is not limited to two-way communication systems of course, and ambient noise may similarly interfere with pre-recorded voices or any pre-stored audio information that is being played back.

OVERVIEW

As disclosed herein, a method for processing an input signal to create an enhanced output signal includes obtaining an envelope of the input signal, determining a logarithm signal of the envelope, determining a rate of change of the logarithm signal to obtain a slope value, and applying a value derived from the slope value to the input signal to thereby generate an enhanced output signal.

Also as disclosed herein, a method for processing an input signal and a noise signal to create an enhanced output signal includes obtaining an envelope of power estimates of the input signal, determining a rate of change of a signal that is a function of the envelope of power estimates, to obtain a slope value, estimating the power of the noise signal over a time interval to obtain a noise power estimate, generating a control signal that is a function of the noise power estimate, scaling the slope value as a function of the control signal, and applying the absolute value of the scaled slope value to the input signal by multiplication to thereby generate an enhanced output signal.

Also as disclosed herein, a multi-band method for processing an input signal and a noise signal to generate an enhanced output signal includes decomposing the input signal into at least two frequency band signals including a first frequency band signal and a second frequency band signal. The method also includes further processing of the first frequency band signal, the further processing comprising:

(a) obtaining an envelope of a power estimate of the first band signal;

(b) determining a logarithm signal comprising the logarithm of an absolute value of the envelope; and (c) determining a rate of change of the logarithm signal to obtain a slope value;

The method also includes estimating the power of the noise signal over a time interval to obtain a noise power estimate, generating a control signal that is a function of the noise power estimate, scaling the slope value as a function of the control signal, applying a function of the scaled slope value to the first band signal by multiplication, to thereby generate an enhanced first band signal, and combining the enhanced first band signal with other frequency band signals to thereby generate the enhanced output signal.

Also as disclosed herein, a signal enhancement circuit includes an input configured to receive an input signal, an envelope detection circuit configured to detect an envelope of the input signal, a logarithm detection circuit configured to detect a logarithm of the envelope of the input signal, a slope detection circuit configured to obtain a slope value of the detected logarithm, a scaling circuit configured to scale the slope value, and a weighting circuit configured to generate an enhanced output signal from the input signal by weighting the input signal as a function of an output of the scaling circuit.

BRIEF DESCRIPTION OF THE DRAWINGS

The accompanying drawings, which are incorporated into and constitute a part of this specification, illustrate one or more examples of embodiments and, together with the description of example embodiments, serve to explain the principles and implementations of the embodiments.

In the drawings.

DESCRIPTION OF EXAMPLE EMBODIMENTS

Figure 1A:
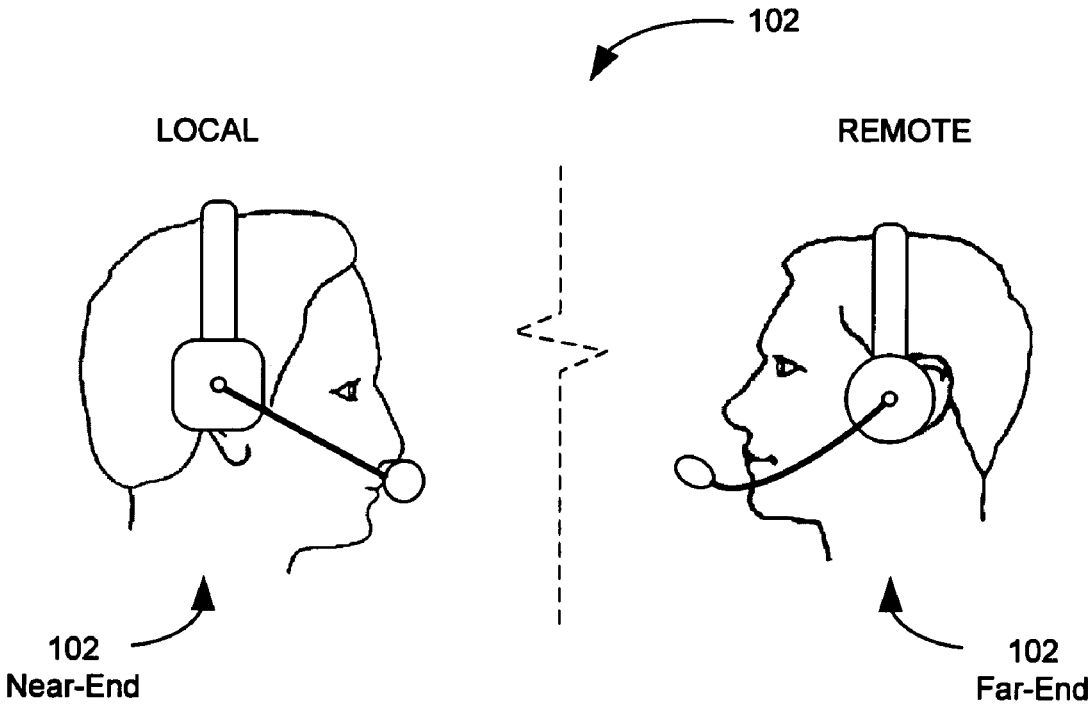
FIG. 1A is a diagram of a two-way audio communication system enabling two users to remotely communicate with one another.

Example embodiments are described herein in the context of a system and method for intelligibility enhancement of audio information. Those of ordinary skill in the art will realize that the following description is illustrative only and is not intended to be in any way limiting. Other embodiments will readily suggest themselves to such skilled persons having the benefit of this disclosure. Reference will now be made in detail to implementations of the example embodiments as illustrated in the accompanying drawings. The same reference indicators will be used to the extent possible throughout the drawings and the following description to refer to the same or like items.

In the interest of clarity, not all of the routine features of the implementations described herein are shown and described. It will, of course, be appreciated that in the development of any such actual implementation, numerous implementation-specific decisions must be made in order to achieve the developer's specific goals, such as compliance with application and business-related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

In accordance with this disclosure, the components, process steps, and/or data structures described herein may be implemented using various types of operating systems, computing platforms, computer programs, and/or general purpose machines. In addition, those of ordinary skill in the art will recognize that devices of a less general-purpose nature, such as hardwired devices, field programmable gate arrays (FPGAs), application specific integrated circuits (ASICs), or the like, may also be used without departing from the scope and spirit of the inventive concepts disclosed herein. Where a method comprising a series of process steps is implemented by a computer or a machine and those process steps can be stored as a series of instructions readable by the machine, they may be stored on a tangible medium such as a computer memory device (e.g., ROM (Read Only Memory), PROM (Programmable Read Only Memory), EEPROM (Electrically Erasable Programmable Read Only Memory), FLASH Memory, Jump Drive, and the like), magnetic storage medium (e.g., tape, magnetic disk drive, and the like), optical storage medium (e.g., CD-ROM, DVD-ROM, paper card, paper tape and the like) and other types of program memory.

The example embodiments described herein are presented in the context of a processes implemented using a digital signal process. It will be recognized that each process step can be accomplished with alternative implementations, for example, using analog circuits. While the hardware supporting an analog implementation would appear different from the hardware implementation in the digital domain, the fundamental nature of each of the corresponding process steps is equivalent. Thus, the processes described herein are intended to be applicable to any hardware implementation in either the analog or digital domain.

FIG. 1A is a diagram of a two-way audio communication system 100 enabling two users to remotely communicate with one another. Each user is provided with a communication device 102, shown in more detail in the block diagram of FIG. 1B. Each communication device 102 includes microphone 104, loudspeaker 106, transceiver 108, and processor or controller 110. In a first communication "circuit," the voice of the user at a remote or far-end location is picked up by a microphone 104 of the communication device 102 at that user's location, and is transmitted, wirelessly or otherwise, for playback by a loudspeaker 106 of the communication device 102 at the local or near-end user's location. Similarly, in a second communication "circuit," the voice of the user in the local or near-end location is picked up by a microphone 104 of a near-end communication device 102 and is played back by a loudspeaker 106 at the remote or far-end location.

The communication system 100 is considered a two-way system, as it contains two communication "circuits" as described. However, it should be understood that the implementations described herein relate to the communication "circuits" individually, and therefore are not limited to two-way systems. Rather, they are also applicable to one-way systems, in which a local or near-end user is only able to hear a remote user, and is unequipped to speak to the remote user, or vice versa. Even more generally, the implementations described herein are applicable to systems that may be exclusively for playback or presentation of audio information, such as music, sound signals and pre-recorded voices, regardless of the state or location of the source of the audio information, and no remote user or audio source need be involved. Such systems include for instance portable and non-portable audio systems such as "walkmans," compact disk players, MP3 players, home or vehicle stereo systems, television sets, personal digital assistants (PDAs), and so on. In such systems, unlike in two-way communication system 100, playback is not necessarily effected in real time—that is, the audio information is not necessarily presented at the same time that it is created, but may be pre-recorded for playback.

Returning to FIG. 1B, the information that the transceiver 108 is expected to transmit in this example is sound signals such as the user's voice, which is picked up by microphone 104 and converted to electrical signals that are forwarded to the transceiver either directly, or by way of controller 110 as depicted. When passed through controller 110, picked-up information can be packaged into suitable form for transmission in accordance with the particular application and/or protocol to be observed between the devices 102 of the communication system 100. Following this packaging, which may be one of numerous types of modulation, for example, the information is forwarded to transceiver 108 for transmission. Conversely, transceiver 108 serves to forward information that it receives, wirelessly or otherwise, to the controller 110 for "unpackaging," and, as detailed below, for processing and manipulation such that when the information is converted to acoustic form during playback by loudspeaker 106, it remains intelligible—or retains its original message or character as much as possible—regardless of the noise environment in which the listening user is immersed.

Transceiver 108 is configured to effect transmission and/or reception of information, and can be in the form of a single component. Alternatively, separate components dedicated to each of these two functions can be used. Transmission can take place in any manner, for example wirelessly by way of modulated radio signals, or in a wired fashion using conventional electrical cabling, or even optically, using optical fibers or through line-of-sight.

Figure 1B:
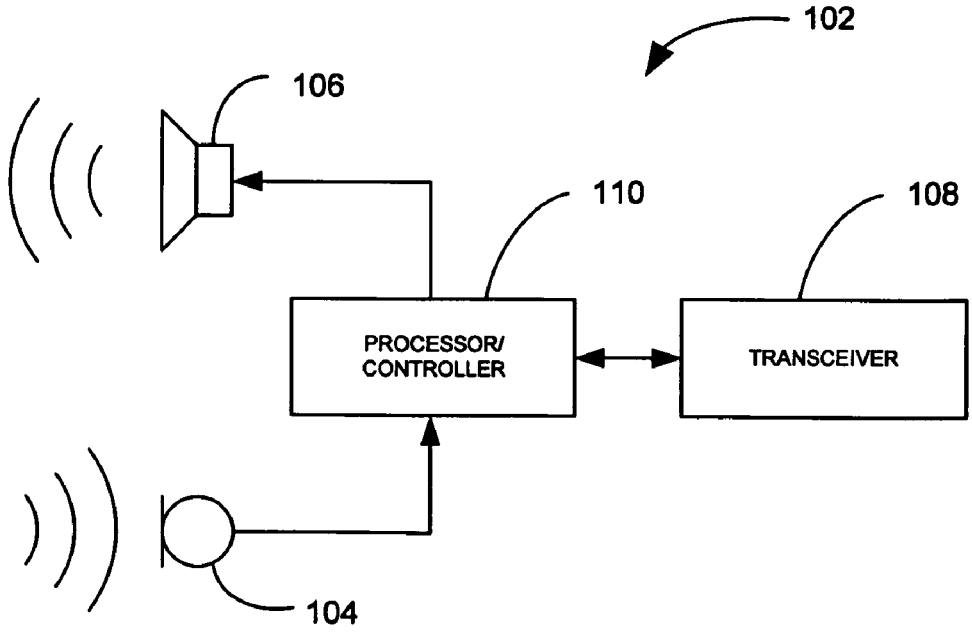
FIG. 1B is a block diagram of a communication device.

Since, in the example of FIGS. 1A and 1B, the far-end talker is at a location remote from the near-end listener, the talker may be ignorant of the noise conditions at the listener's location, and the talker may not take measures to compensate for the occurrence of disruptive noise events (instantaneous or sustained) at the location of the listener because the talker may not be aware of their occurrence. Normally, when the talker and listener are in the same environment, the talker will respond to a disruptive noise event, such as the passing of a vehicle, by raising his voice, or by enunciating his words better. The disclosure herein aims primarily to emulate the effect of the latter situation—that is, to improve "enunciation" of words in played back audio signals, or more generally and technically, to "sharpen" the audio signals being presented, in response to instantaneous or sustained disruptive noise events. This is done by manipulating—manually, or automatically and dynamically—the envelope of the logarithm of the speech carrying-signal, as explained in more detail below. Control of the "sharpness" of the signal allows enhancement of the information-rich consonant sounds in speech. This is akin to increased enunciation of words as is performed by a talker who is compensating for the effects of a noisy acoustic environment. The increase in sharpness in effect enhances the plosives (oral or nasal stops) in speech, and thereby enhances intelligibility. As will be appreciated, this can be performed in one-way or two-way systems, and in real time (that is, as the information—the words for instance—are being created), or otherwise (pre-recorded). And, to repeat, the processing thus performed is not restricted to information containing words, but is applicable to generally sharpen the played back signal as necessary, regardless of its content.

Figure 2:
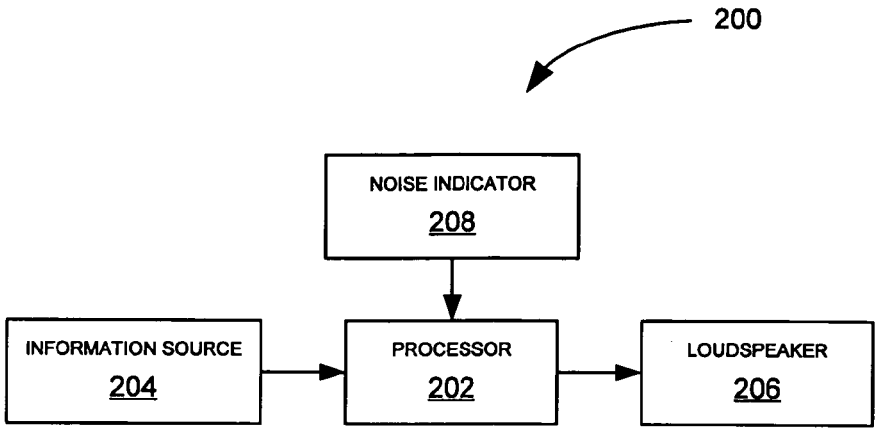
FIG. 2 is a block diagram of a generalized communication system.

FIG. 2 illustrates a generalized application in accordance with the disclosure, wherein, in a sound delivery system 200, a processor 202 operates on audio information provided by an audio information source 204, manipulating the information and taking necessary measures to compensate for compromised listening environment conditions before delivering it in the form of an output drive or playback signal to a loudspeaker 206 for presentation or playback to a user.

In system 200, a representation or weight of the ambient audio noise at the playback location is generated by an audio noise indicator 208. In such cases, the playback systems may be equipped with a microphone, if one is not already available. The manipulation and enhancement is conducted in real-time and may be either continuous or in the form of discrete instantaneous samplings. The representation or weight, which may hereinafter be referred to as the ambient noise indicia, or noise indicia, is provided to the processor 202, which uses it, in conjunction with the information signal from information source 204, to effect the necessary enhancement at playback.

The indicator 208 from which the indicia may be derived can be a simple microphone, or an array of microphones (for example microphone(s) 104 of FIG. 1B), that is/are used to detect ambient noise at the playback location. Alternatively (or in addition), the noise indicia can be derived from ancillary processing operations that are performed elsewhere in the system, or in a connected system, for the same or a related purpose, or for a different purpose altogether. For instance, in a two-way system, the noise indicia may be derived from a noise reduction algorithm used at the near-end to enhance an outgoing audio signal in the presence of the ambient noise. A determination of the ambient noise can be obtained by such a noise reduction algorithm in a variety of ways, and this determination can be used to provide the noise indicia needed by the sound delivery system 200 to improve playback. The noise reduction algorithm for the outgoing audio signal can, for instance, be one that uses multi-band methods to create a set of attenuation values that are applied to the outgoing noisy signal by multiplication. The attenuation values may be a number between "0" and "1". When applied to the outgoing noisy signal they act to reduce the noise therein by attenuating portions of the noisy signal that are deemed to be mostly or only noise, while not attenuating, or attenuating to a lesser degree, portions that are deemed to be the desired signal. The sound delivery system 200 can obtain the noise indicia by subtracting each attenuation value from "1". The sound delivery system 200 can then apply the thus-derived "anti-attenuation" values to the original noisy signal to thereby derive the noise indicia from noise indicator 208. Further, in one variation, discussed at length below, it may be desirable to use the attenuation values themselves by 1) squaring them so they represent a power percent, 2) summing the resulting values within each frequency band to obtain a total percentage measure of non-noise power per band, 3) calculating the total power of the original noisy signal in each band, and 4) multiplying the noise percentage, which is 100% minus the non-noise power percentage, times the total power to get a noise-only power measure in each band.

Figure 3:
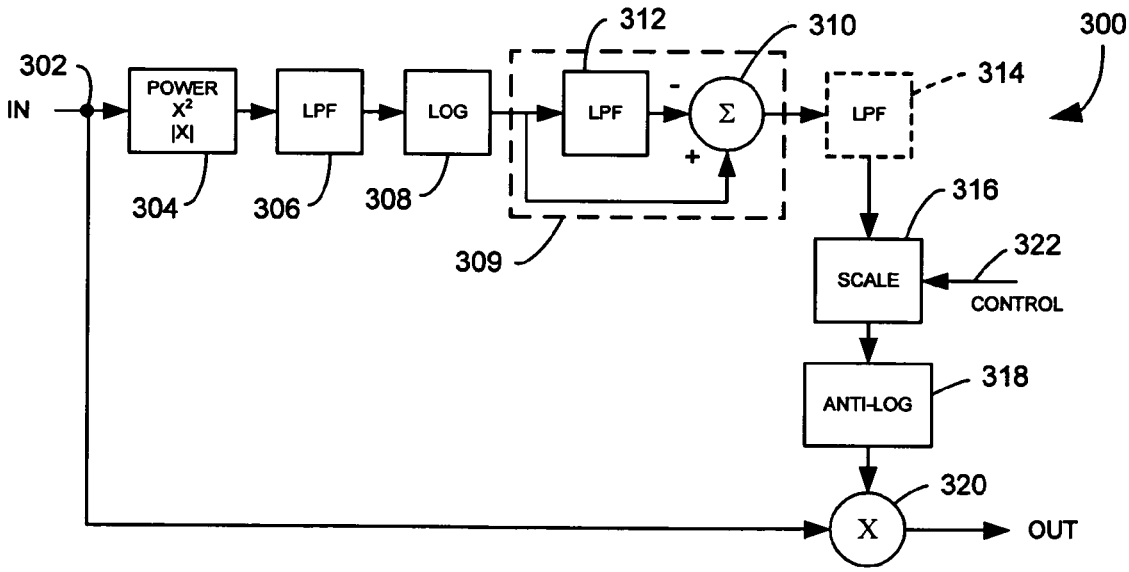
FIG. 3 is a schematic diagram of one example of an intelligibility enhancement circuit which can be used to enhance the intelligibility of audio information to be presented to a speaker.

FIG. 3 is a schematic diagram of one example of an intelligibility enhancement circuit 300 which can be used to enhance the intelligibility of audio information to be presented to a speaker. The intelligibility enhancement to which the FIG. 3 embodiment pertains is implemented in the time domain, although it is to be understood that the principles of this embodiment readily carry over to a frequency domain implementation. Further, it will be appreciated that while the processing can be analog, to be carried out by analog circuits, it is described herein in terms of a digital approach, wherein the input signals to the intelligibility enhancement circuit 300 are digitally sampled and the processing in the circuit is conducted digitally. A typical digital implementation for a communication application could use 16 bit samples taken at sample rate of 8,000 sps (samples per second), thus supporting voice communications typically considered to fall into a bandwidth between 300 Hz and 3400 Hz. Applications requiring higher fidelity would have higher sample rates and possibly larger bit depths.

The intelligibility enhancement circuit 300 can be part of the processor/controller circuit 110 of communication device 102 (FIG. 1B), or, more generally, part of processor 202 of sound delivery system 200 (FIG. 2). At an input 302 of circuit 300, an original, unenhanced input signal is provided. The input signal is derived, for example, from the information source 204 in sound delivery system 200, and can correspond to the far-end talker's voice as received by the transceiver 108 of communication device 102 of FIG. 1B. Alternatively, the input signal can be derived from a storage medium (digital memory, optical medium, magnetic medium) or from a broadcast source, for example a television signal or a conventional radio (FM or AM) or a satellite transmission.

Figure 7:
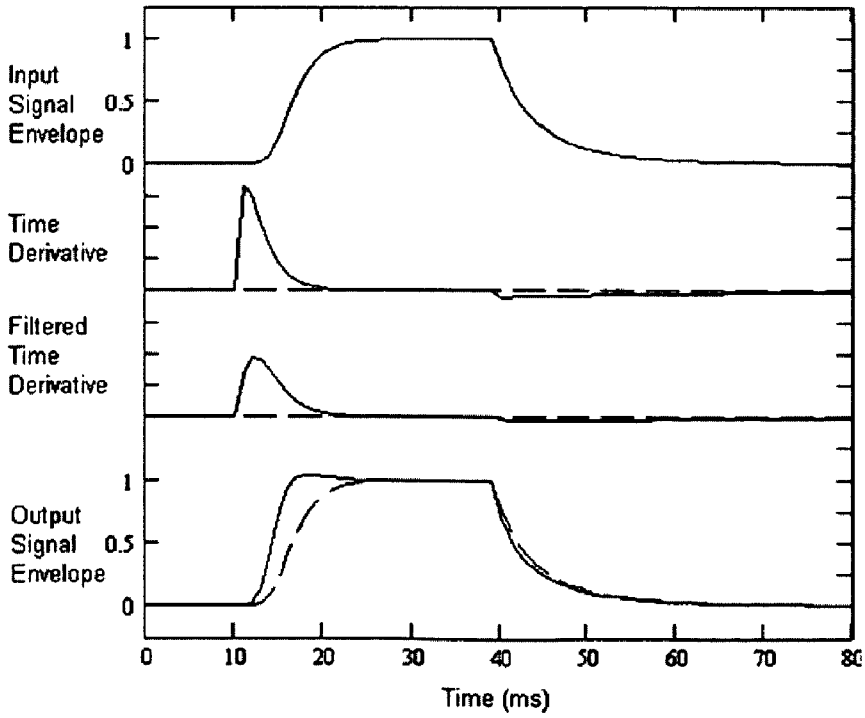
FIG. 7 is a graph of simulated signals of the intelligibility enhancement process.

Intelligibility enhancement circuit 300 comprises multiple functional blocks described, for purposes of simplicity only, as individual circuits. While the functions of these blocks can be performed by individual digital circuits including components such as gate arrays, it will be recognized that equivalent analog circuits could be alternatively utilized, as indicated above, and that the corresponding functions could also be implemented in a circuit using a general purpose processor or digital signal processor. Intelligibility enhancement circuit 300 operates on the envelope of the input signal received at input 302 and detects the slope of the logarithm of the signal. This is effected by first applying the signal from input 302 to a power determining circuit 304, which can be implemented as a circuit that squares the input signal, or takes its absolute value, for example. FIG. 7 is a graph of example signals of the intelligibility enhancement process. The top trace of FIG. 7 illustrates the signal envelope of an idealized speech burst, shown on a linear vertical scale, after the signal power envelope is determined by power determining circuit 304. Although it is feasible to perform intelligibility enhancement in the linear domain, it is advantageous to use the logarithmic domain. By using the logarithm of the envelope of the power of the signal, this embodiment provides intelligibility enhancement in a manner consistent with the psychoacoustic response to sound amplitude as an inherently logarithmic perception. The output of circuit 304 is provided to low pass filter 306. A simple digital low-pass infinite impulse response (IIR) filter can be used, which can be an exponential filter described by the equation $$Out_t = Out_{t-1} + \alpha \cdot (In_t - Out_{t-1}) \quad (1)$$

where $Out_t$ is the current value of the output signal of the filter, $Out_{t-1}$ is the previous value of the output signal of the filter, $In_t$ is the current value of the input signal to the filter, and $\alpha$ is an exponential time constant parameter that determines the cut-off frequency of the exponential filter. This filter is a simple-to-implement, low-compute-cost, low-pass filter. However, any low-pass filter, whether IIR or finite impulse response (FIR) or other, can be used. The combined operation of power determining circuit 304 and low pass filter 306 provides envelope detection.

The output from low pass filter 306 is applied to logarithm circuit 308, which obtains the logarithm of the filtered signal. Typically a very small constant value is added to the output from low pass filter 306 before logarithm circuit 308 determines its logarithm, thus preventing any attempt to calculate the logarithm of zero, which is indeterminate. The sequence of detecting the envelope using power determining circuit 304 and low pass filter 306, followed by calculation of the logarithm of the envelope, is an effective, but not exclusive method of determining the log of the envelope of the power of the signal. Alternatively, the logarithm of the output of power determining circuit 304 can be calculated and provided to low pass filter 306. This approach will produce the same result. Computational costs in the digital implementation can be reduced with the appreciation that the modulation rate of speech, which determines the envelope, is relatively slow. Therefore, an envelope-based process need not use every sample of a speech waveform in order to perform its process. Indeed, the modulation rate of speech rarely exceeds 30 Hz, and for this reason a modulation-related process can be performed at a similar rate (the Nyquist criterion states that a sample rate needs to exceed twice the highest frequency, so a minimum control process sample rate would be >60 samples per second, or sps). Conservatively, a somewhat higher rate will prevent too much control signal delay, and preserve control signal fidelity, so a sampling rate at about 500 sps is reasonable, and is well below the example 8,000 sps sample rate of the speech signal. The logarithm circuit 308 is used to produce the logarithm of the envelope of the incoming information signal $$E_j = \log\left[\max(|X_i|)\right] \tag{2}$$

where $X_t$ is the value of each sample of the input signal in a $j^{th}$ sequential group (of N samples) and $E_j$ is the value of the log envelope for the $j^{th}$ sub-sample. As an example, assume that the speech signal is sampled at 8,000 sps, and N is chosen to be 16. A first group of 16 sequential samples of the input signal is scanned for the one having the largest magnitude, and that sample's magnitude is converted to its logarithmic value creating the first envelope value. Then the next subsequent group of 16 samples of the input signal is likewise used to compute a second value of the envelope, and so on. The index j is the index for the envelope data, which is sampled at 500 sps. Thus, the envelope data and enhancement gain calculations are carried out at 500 times-per second rather than at 8,000 times per second, thereby saving substantial computational resources, while preserving 250 Hz of speech modulation rate information, which is more than sufficient for excellent fidelity and low processing delay.

The logarithm signal is applied to a slope detector circuit 309, which determines the rate of change of the logarithm signal. Specifically, the input signal at slope detector circuit 309 is combined subtractively, in combiner 310, with a low passed filtered version of itself. The low passed version is obtained through a low pass filter 312. As in the case of filter 306, filter 312 can be a simple digital low-pass infinite impulse response (IIR) filter. This filter is a simple to implement, low compute cost, low-pass filter. However, any low-pass filter, whether IIR or finite impulse response (FIR) or other, can be used. The operation of the low pass filter 312 and combiner 310 is to, in effect, detect the slope of the logarithm of the signal from low pass filter 306. The above described method is desirable because it is simple and low cost; however any method for determining the slope of the logarithm of the envelope signal is contemplated, including calculating the true derivative of the logarithm signal.

Figure 3A:
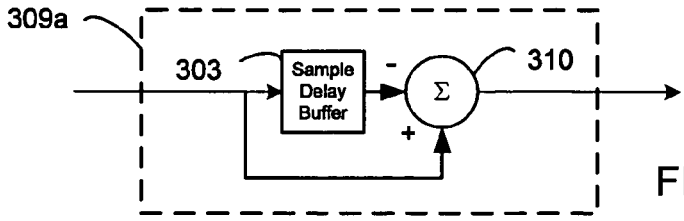
FIGS. 3A and 3B are block diagrams of alternate means for detecting slope.
Figure 3B:
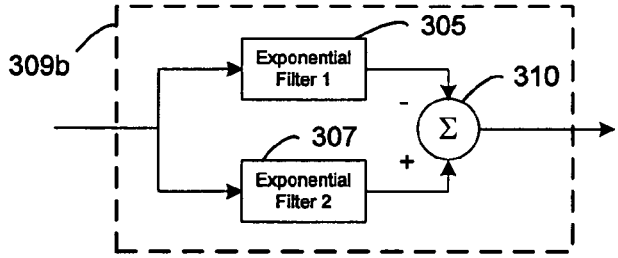

When processing sampled data, it is also possible to envelope-track in the linear domain, log convert the linear envelope and then detect the envelope's slope by subtraction of a previous value from the current value. This process is shown in FIG. 3A and is defined by the equation $$\frac{d}{dt_j} = (X_j - X_{j-1}), \tag{3}$$

where $$\frac{d}{dt_j}$$

is the local time derivative of the signal X at time index j, thus producing the slope value—that is, the first derivative of the log of the envelope signal. Slope detector circuit 309*a* uses sample delay buffer 303 to hold the signal $X_{j-1}$, or potentially an earlier sample, for subtraction from $X_j$ in combiner 310 to create a signal that represents the slope of the logarithm of the envelope of the voice signal. The second trace of FIG. 7, shown on a logarithmic vertical axis, represents the output of the 1-sample delay slope detector when its input is that shown in the top trace. Other alternative methods of creating a signal proportional to slope are also contemplated. For example, another means for detecting the slope is to subtract the log-filtered envelope signal from the output of a second cascaded low-pass filtered version of the same signal, as shown in FIG. 3B, in which the signal is input to first and second exponential filters 305, 307 of slope detector circuit 309*b*, and the difference is obtained at combiner 310. Since a low-pass filter has nearly constant delay over some portion of its bandwidth, this delay can be substituted for the single-sample delay.

The output of combiner 310 can be optionally applied to a low pass filter 314, before passing to scaling circuit 316. As in the case of filters 306 and 312, filter 314 can be a simple digital low-pass infinite impulse response (IIR) filter. Alternatively, any low-pass filter, whether IIR or finite impulse response (FIR) or other, can also be used. The third trace of FIG. 7 shows the result of applying low pass filter 314 to the slope detected signal. The antilog of the scaled signal is taken at antilog circuit 318. The output signal from antilog circuit 318 is then used to weight the original input signal from input 302, at weighting circuit 320. The output of weighting circuit 320 is then provided as an output of the intelligibility enhancement circuit 300, and can then be used to drive a loudspeaker such as 106 or 206. The fourth, or bottom trace of FIG. 7 illustrates the envelope of the output speech burst signal after the application of the gain signal (solid line), against the original input speech burst envelope (dashed line—identical to the top trace). As can be seen in the fourth trace, both the initial rising edge of the speech burst and the trailing falling edge are enhanced by being increased and decreased over the input respectively. However, it is to be understood that either enhancement alone, or both combined, are contemplated. The intelligibility enhancement circuit 300 is compatible with, and may be combined either ahead of or following, other audio processing circuits such as equalization processors, dynamic range processors, amplifiers, or the like.

Scaling by scaling circuit 316 provides one, but not the only, method to control the enhancement gain. The amount of scaling applied by scaling circuit 316 can be adjustable using an adjustment signal 322. For instance, the adjustment signal 322 can be dynamic and a function of the ambient noise, such that the greater the ambient noise, the greater the adjustment value that is automatically applied to the scaling circuit 316. The adjustment signal can thus correspond to a version of the aforementioned noise indicia or noise indicator signal 208 (FIG. 2), for example from microphone 104 (FIG. 1B). Alternatively, the adjustment signal can be manually controlled by a user—for instance by a knob or slider that the user can manipulate based on personal preference. It is also possible to provide an aggressiveness factor to the adjustment signal 322, such that the degree or level of adjustment that it provides can be controlled.

Figure 3C:
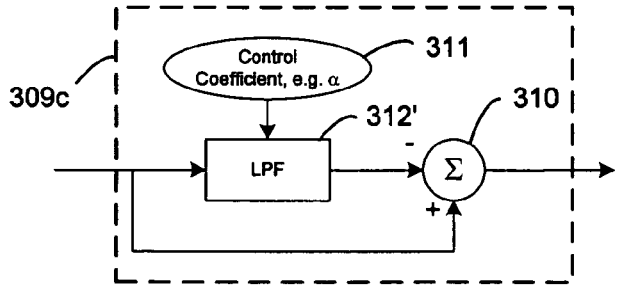
FIG. 3C is a block diagram illustrating dynamically varying the $\alpha$ value of a second cascaded low-pass filter.

Besides scaling the enhancement gain, another way to create the adjustment of the amount of enhancement is to dynamically vary the $\alpha$ value of the low-pass filter 312, as illustrated in FIG. 3C, wherein $\alpha$ coefficient control input 311 is provided to low pass filter 312'. The output of filter 312' is then applied to combiner 310 in the manner described above. The lower the value of this $\alpha$ parameter, the greater will be the amount of intelligibility enhancement. This method of changing the magnitude of the slope value can be either an alternative to or an addition to scaling the magnitude of the slope value, thereby creating the scaled slope value. Also, the value of the $\alpha$ parameter of filter 307 (FIG. 3B) can be raised to increase the amount of intelligibility enhancement.

It is also possible to apply enhancement to both the beginning and end of a speech utterance. This is useful, for example, for words with important consonant sounds at both ends, like the words "talk", "post", "cast", etc. To accomplish this approach: 1) the slope detector 309 can be configured to output only the magnitude of the slope; 2) the output of the slope detector 309 can be rectified; 3) the output of the logarithm circuit 308 can be rectified before determining the slope; 4) the log signal or the slope signal can be checked with a conditional statement, whereby the positive values are passed unchanged, but the negative input values are converted to positive values either with no change in amplitude or with the amplitude scaled so that the formerly negative values are output with a different "gain" than are the positive input values. This last approach allows for enhancing the initial consonant sounds by a different amount than the trailing consonant sounds.

Figure 4:
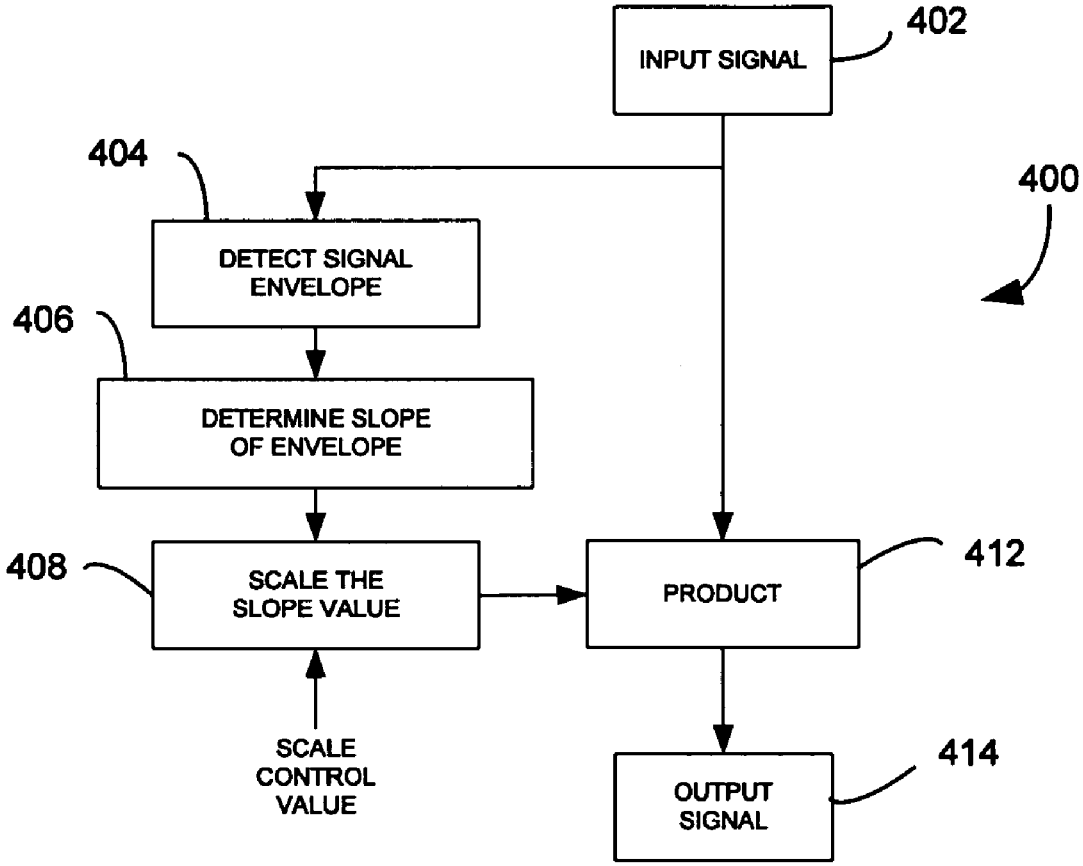
FIG. 4 is a flow diagram of a process for sharpening an audio signal for delivery to a listener.

FIG. 4 is a flow diagram of a process 400 for sharpening a played back audio signal consistent with the foregoing approach. The original signal is input at 402. At 404, an envelope of the input signal is detected. At 406, the slope of the envelope is determined. The slope value is scaled at 408. A scale control value can be applied at 410. As described above, various methods can be applied to obtain positive-only values for the slope, and the scale control can be made configurable to apply different gain corresponding to the rising and falling portions of the envelope. The resultant signal is multiplied with the original signal 412, and an output is obtained at 414.

As previously mentioned, the intelligibility enhancement operation described herein can be performed and implemented in the frequency domain as well as the time domain. Those versed in the art will recognize that each of the processes described above for the intelligibility enhancement operation have frequency domain equivalent processes and as such, this invention should be considered include frequency domain as well as time domain implementations.

Figure 5:
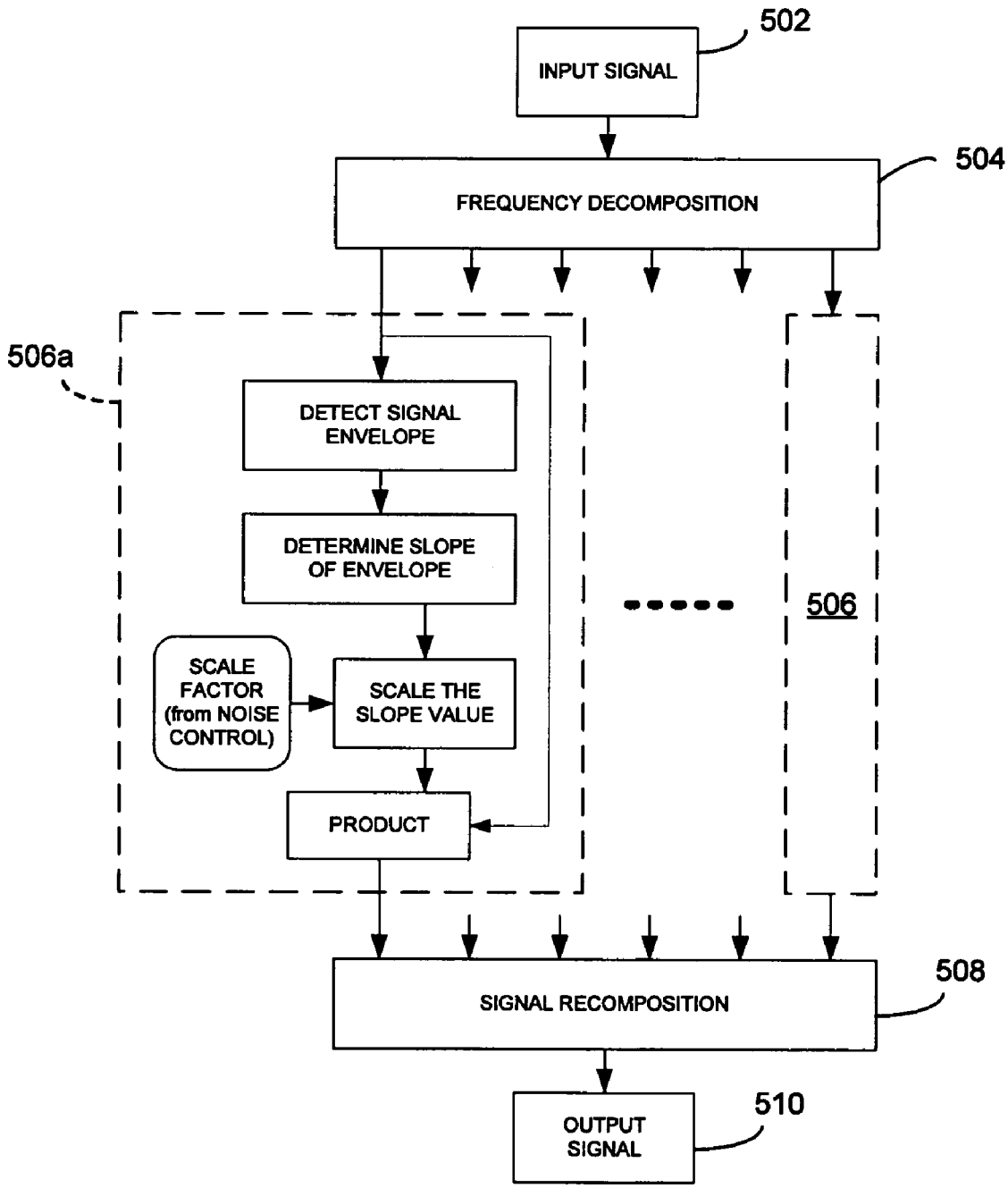
FIG. 5 is a block diagram of a multi-band intelligibility enhancement process.

Further, in either domain, it is possible to conduct the processing on a single-band basis, or on a multi-band basis. Multi-band operation, described with reference to FIG. 5, involves dividing the input information signal 502 into multiple frequency bands. For instance, the input signal can be divided by a frequency decomposition module 504, into n bands that are each processed separately. Processing can take place in processors 506, each for instance applying its own parameters. The first such processor 506*a* is shown as applying the process of FIG. 4 to its frequency band, and the other processors may apply to their frequency bands the same process with different parameters, or they may apply variations on that process. After processing in the individual processors 506, the signals are combined in signal recombination module 508, and then output at 510. In this manner, the enhancement, and the control and degree thereof, can be applied differently to the different bands, so that more realistic outputs can be obtained. In an example two-band system, a signal cutoff at 1 kHz may be used. Signals above the cutoff are processed and manipulated in a first processor (506*a*), while those above the cutoff are processed in a different processor. Of course the number of bands in the multi-band approach used is not limited to two.

Figure 6:
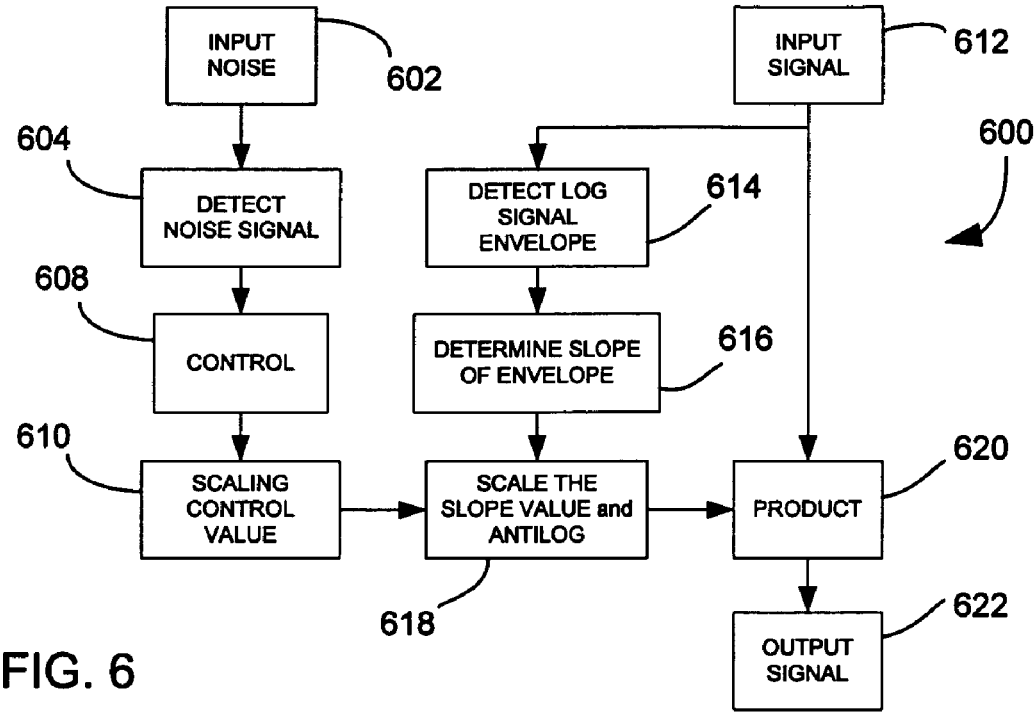
FIG. 6 is a block diagram showing an approach in which the noise signal and the information signal are separately processed and the information signal is modified by the processed noise signal.

A typical implementation of the intelligibility enhancement operation described herein would separately process the noise signal and the information signal, as described with reference to system 600 of FIG. 6. The ambient noise signal or indicia, for example from microphone 104 (FIG. 1B) or noise indicator 208 (FIG. 2), is received at input 602. At 604, the noise signal is detected. Detection of the noise signal typically consists of summing the values either of the square or of the absolute value of the noise signal over a period of time corresponding to the speech modulation rate used in the detect signal envelope processes 404 and 614. A control signal is generated from the detected noise signal at 608, which may be accomplished by simply calculating the logarithm of the detected noise signal, or may involve mapping of some other predetermined function onto the power level. A scaling control value is obtained, at 610 by applying an appropriate amount of gain to the output of control generator 608. Also input into the system, at input 612, is an information signal, for example the voice from a talker at the far-end, or a prerecorded voice or the like, from for example information source 204 (FIG. 2). At 614, a log signal envelope of the information is detected. At 616, the slope of the envelope is detected. The slope value is then scaled at 618 by scaling control value obtained at 610. The result is multiplicatively applied, at 620, to the input information signal, and the output is generated at 622.

Applications of the system and method described herein include most communications systems and for both transmitted and received signals (either or both signal directions in two-way communications). In particular, they are well suited for any sound delivery system where competing ambient noise is a problem, such as cellular phones, automotive (car) radios, walkie-talkies, public safety radios, military and sporting helmet systems, and even computer and TV sound systems.

Another application is in the area of pre-emphasis to overcome additive noise or slow response in a recording or communications channel. By applying this process to a signal prior to recording or transmission, the process could be tuned to compensate for slow response characteristics, or be subsequently removed after the channel noise is added in order to create a noise-reduced and more intelligible output signal.

While embodiments and applications have been shown and described, it would be apparent to those skilled in the art having the benefit of this disclosure that many more modifications than mentioned above are possible without departing from the inventive concepts disclosed herein.

What is claimed is:

1. A method for processing an input signal to create an enhanced output signal, the method comprising:

obtaining an envelope of the input signal;

determining a logarithm signal of the envelope;

determining a rate of change of the logarithm signal to obtain a slope value; and applying a value derived from the slope value to the input signal to thereby generate an enhanced output signal.

2. The method of claim 1, wherein the input signal is sampled at an input signal sample rate and the processes of obtaining an envelope of the input signal, and determining a logarithm signal of the envelope are performed at a rate that is less than the input signal sample rate.

3. A method for processing an input signal to create an enhanced output signal, the method comprising:

determining a logarithm signal of the input signal;

obtaining an envelope of the logarithm signal;

determining a rate of change of the envelope to obtain a slope value; and applying a value derived from the slope value to the input signal to thereby generate an enhanced output signal.

4. The method of claim 1, further including scaling the slope value, wherein the scaled slope value is the value derived from the slope value that is applied to the input signal.

5. The method of claim 4, wherein the scaling is a function of ambient noise.

6. The method of claim 1, wherein the slope is determined using one of:

a. subtraction of a low pass filtered version of the logarithm signal from the logarithm signal;

b. subtraction of a delayed version of the logarithm signal from the logarithm signal;

c. calculation of the difference of the output signals from two low pass filters; and, d. calculation of the derivative of the logarithm signal.

7. The method of claim 1, wherein the input signal is an audio signal.

8. The method of claim 7, wherein the audio signal is a voice signal.

9. The method of claim 4, wherein the scaling is user-adjustable.

10. The method of claim 1, wherein obtaining the envelope includes generating squared values of the input signal.

11. The method of claim 1, wherein obtaining the envelope includes generating absolute values of the input signal.

12. The method of claim 1, further including scaling the slope value and determining the antilogarithm of a function of the scaled slope value, wherein the antilogarithm of the function of the scaled slope value is the value derived from the slope value that is applied to the input signal.

13. The method of claim 4, wherein scaling the slope value includes applying differing scaling factors to the slope value as a function of the sign of the slope value.

14. The method of claim 1, wherein the slope value is determined using a low pass filter, and at least one parameter of the low pass filter is varied as a function of ambient noise.

15. The method of claim 5, wherein the ambient noise is represented as an input noise signal, and said input noise signal is processed to determine an estimate of noise power over a time interval, and to generate a control signal that is a function of the noise power estimate, said control signal being used to control the scaling of the slope value.

16. The method of claim 5, wherein the ambient noise is represented as an input noise signal, said input noise signal is decomposed into at least two frequency sub-bands, and at least one of said sub-bands is processed to determine an estimate of noise power over a time interval for that sub-band, and to generate a sub-band control signal that is a function of the noise power estimate, said sub-band control signal being used to control the magnitude of the slope value.

17. The method of claim 14, wherein the ambient noise is represented as an input noise signal, and said input noise signal is processed to determine an estimate of noise power over a time interval, and to generate a control signal that is a function of the noise power estimate, said control signal being used to control said at least one parameter of the low pass filter.

18. A method for processing an input signal and a noise signal to create an enhanced output signal, the method comprising:

obtaining an envelope of power estimates of the input signal;

determining a rate of change of a signal that is a function of the envelope of power estimates, to obtain a slope value;

estimating the power of the noise signal over a time interval to obtain a noise power estimate;

generating a control signal that is a function of the noise power estimate;

modifying the slope value as a function of the control signal; and applying the modified slope value to the input signal by multiplication to thereby generate an enhanced output signal.

19. The method of claim 18, wherein the slope is determined using one of:

a. subtraction of a low pass filtered version of the logarithm signal from the logarithm signal;

b. subtraction of a delayed version of the signal that is a function of the envelope of power estimates from the signal that is a function of the envelope of power estimates;

c. calculation of the difference of the output signals from two low pass filters; and, d. calculation of the derivative of the signal that is a function of the envelope of power estimates.

20. The method of claim 18, wherein the input signal is an audio signal.

21. The method of claim 20, wherein the audio signal is a voice signal.

22. The method of claim 18, wherein the input signal is sampled at an input signal sample rate and the processes of obtaining an envelope of power estimates of the input signal, determining a rate of change of a signal, estimating the power of the noise signal, and generating a control signal, are performed at a rate that is less than the input signal sample rate.

23. The method of claim 18, wherein modifying the slope value includes controlling the magnitude of the slope value as a function of the sign of the slope value.

24. The method of claim 18, further including determining a logarithm signal comprising the logarithms of a function of the envelope, wherein the logarithm signal is the signal of which the rate of change is determined to obtain a slope value.

25. A multi-band method for processing an input signal and a noise signal to generate an enhanced output signal, the method comprising:

decomposing the input signal into at least two frequency band signals including a first frequency band signal and a second frequency band signal;

further processing the first frequency band signal, said further processing comprising:

(d) obtaining an envelope of power estimates of the first frequency band signal;

(e) determining a logarithm signal comprising the logarithm of a function of the envelope; and (f) determining a rate of change of the logarithm signal to obtain a slope value;

estimating the power of the noise signal over a time interval to obtain a noise power estimate;

generating a control signal that is a function of the noise power estimate;

modifying the slope value as a function of the control signal;

applying a function of the modified slope value to the first frequency band signal by multiplication, to thereby generate an enhanced first frequency band signal; and combining the enhanced first frequency band signal with other frequency band signals to thereby generate an enhanced output signal.

26. The method of claim 25, wherein generating said control signal includes: decomposing said noise signal into at least two frequency sub-bands, processing at least one of said sub-bands to determine an estimate of noise power over a time interval for that sub-band, and generating a sub-band control signal that is a function of the sub-band noise power estimate, said sub-band control signal being the control signal used to modify the slope value.

27. The method of claim 25, wherein the input signal is sampled at an input signal sample rate and the processes of obtaining an envelope of power estimates of the first frequency band signal, determining a logarithm signal, determining a rate of change of the logarithm signal estimating the power of the noise signal, and generating a control signal, are performed at a rate that is less that the input signal sample rate.

28. A multi-band method for processing an input signal and a noise signal to generate an enhanced output signal, the method comprising:

decomposing the input signal into at least two frequency band signals including a first frequency band signal and a second frequency band signal;

further processing at least one of the first frequency band signal and second frequency band signal, said further processing comprising:

(a) determining a logarithm signal comprising the logarithm of the first frequency band signal;

(b) obtaining an envelope of the logarithm signal; and (c) determining a rate of change of the envelope to obtain a slope value;

estimating the power of the noise signal over a time interval to obtain a noise power estimate;

generating a control signal that is a function of the noise power estimate;

modifying the slope value as a function of the control signal;

applying a function of the modified slope value to the first frequency band signal by multiplication, to thereby generate an enhanced first frequency band signal; and combining the enhanced first frequency band signal with other frequency band signals to thereby generate an enhanced output signal.

29. The method of claim 25, wherein the modifying of the slopevalue is a function of the sign of the slope value.

30. A signal enhancement circuit comprising:

an input configured to receive an input signal;

an envelope detection circuit configured to detect an envelope of the input signal;

a logarithm determination circuit configured to determine a logarithm of the envelope of the input signal;

a slope detection circuit configured to obtain a slope value of the determined logarithm wherein the magnitude of the slope value is adjusted to generate a scaled slope value by performing at least one of;

a. modifying a parameter of the envelope detection circuit, and b. scaling the slope value following the slope detection; and a weighting circuit configured to generate an enhanced output signal from the input signal by weighting the input signal as a function of the scaled slope value.

31. The circuit of claim 30, wherein the input signal is an audio signal.

32. The circuit of claim 31, wherein the audio signal is a voice signal.

33. The circuit of claim 30, further including an ambient noise detection circuit, the amount of magnitude adjustment being controlled as a function of an output of an ambient noise detection circuit.

34. The circuit of claim 30, wherein the amount of magnitude adjustment is a function of the sign of the slope value.

35. The circuit of claim 30, wherein the amount of magnitude adjustment is controlled as a function of user input.

36. The method of claim 4, wherein applying the scaled slope value to the input signal includes determining the absolute value of the scaled slope value, and applying a function of the absolute value of the scaled slope value to the input signal by multiplication.

37. The method of claim 4, wherein scaling the slope value includes applying differing amounts of magnitude adjustment to the slope value as a function of the sign of the slope value.

* * * * *